US005988066A

United States Patent [19]

Robinson et al.

[11] Patent Number: 5,988,066

[45] Date of Patent: Nov. 23, 1999

[54] PROCESS OF MAKING LITHOGRAPHIC SHEET MATERIAL FOR LASER IMAGING

[75] Inventors: Edward C. Robinson, New Kensington; Jean Ann Skiles, Gibsonia; Larry F. Wieserman, Apollo, all of Pa.

[73] Assignee: Aluminum Company of America, Pittsburgh, Pa.

[21] Appl. No.: 09/013,374

[22] Filed: Jan. 26, 1998

[51] Int. Cl.[6] ..... B41N 1/14; B41C 1/10

[52] U.S. Cl. ..... 101/457; 101/467; 101/395; 101/401.1

[58] Field of Search ..... 101/453, 454, 101/457, 462, 467, 401.1, 395

[56] References Cited

U.S. PATENT DOCUMENTS

| | | | |
|---|---|---|---|
| Re. 35,512 | 5/1997 | Nowak et al. | 101/454 |
| 4,461,663 | 7/1984 | Tachibana et al. | 101/375 |
| 5,188,032 | 2/1993 | Lewis et al. | 101/453 |
| 5,339,737 | 8/1994 | Lewis et al. | 101/454 |
| 5,353,705 | 10/1994 | Lewis et al. | 101/453 |
| 5,378,580 | 1/1995 | Leenders | 101/467 |
| 5,407,702 | 4/1995 | Smith et al. | 427/211 |
| 5,440,987 | 8/1995 | Williams et al. | 101/467 |

FOREIGN PATENT DOCUMENTS

| | | | |
|---|---|---|---|
| 1050805 | 3/1979 | Canada | 101/467 |

OTHER PUBLICATIONS

Research Disclosure April 1980, 19201 "Method and material for the production of a dry planographic printing plate", p. 131, Leenders et al.

*Primary Examiner*—Stephen R. Funk
*Attorney, Agent, or Firm*—Glenn E. Klepac

[57] ABSTRACT

A sheet material suitable for imaging by laser radiation includes a substrate, an adhesive layer comprising a thermoplastic or elastomeric polymer coated onto the substrate, and a particle layer adhered to the adhesive layer and comprising a plurality of carbon or metal or mineral particles that are subject to laser ablation. The particle layer preferably contains alumina particles. The adhesive layer may be filled with particles and is preferably filled with titanium dioxide particles that are more sensitive to laser radiation than the thermoplastic or elastomeric polymer. Preferably, a silicone or silicate layer that is not subject to laser ablation overlies the particle layer.

19 Claims, 2 Drawing Sheets

PROCESS OF MAKING LITHOGRAPHIC SHEET MATERIAL FOR LASER IMAGING

FIELD OF THE INVENTION

The present invention relates to lithographic printing sheet materials that are suitable for imaging by digitally controlled laser radiation.

BACKGROUND OF THE INVENTION

Printing plates suitable for imaging by digitally controlled laser radiation are known in the prior art. However, none of the prior art printing plates is entirely suitable for its intended purpose. Accordingly, there remains a need for a printing plate suitable for laser imaging that is both effective and economical.

Laser radiation suitable for imaging printing plates preferably has a wavelength in the near-infrared region, between about 700 and 1500 nm. Solid state laser sources (commonly termed "semiconductor lasers") are economical and convenient sources that may be used with a variety of imaging devices. Other laser sources such as $CO_2$ lasers and lasers emitting light in the visible and UV wavelengths are also useful.

Laser output can be provided directly to the plate surface via lenses or other beam-guiding components, or transmitted to the surface of a blank printing plate from a remotely sited laser through a fiber-optic cable. A controller and associated positioning hardware maintains the beam output at a precise orientation with respect to the plate surface, scans the output over the surface, and activates the laser at positions adjacent selected points or areas of the plate. The controller responds to incoming image signals corresponding to the original figure or document being copied onto the plate to produce a precise negative or positive image of that original. The image signals are stored as a bitmap data file on a computer. Such files may be generated by a raster image processor (RIP) or other suitable means. For example, a RIP can accept data in page-description language, which defines all of the features required to be transferred onto a printing plate, or as a combination of page-description language and one or more image data files. The bitmaps are constructed to define the hue of the color as well as screen frequencies and angles.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, it is generally preferable (for reasons of speed) to employ a plurality of lasers and guide their outputs to a single writing array. The writing array is then indexed, after completion of each pass across or along the plate, a distance determined by the number of beams emanating from the array, and by the desired resolution (i.e., the number of image points per unit length).

Some prior art patents disclosing printing plates suitable for imaging by laser ablation are Lewis et al U.S. Pat. Nos. 5,339,737 and 5,353,705 and Nowak et al Re. U.S. Pat. No. 35,512. The disclosures of those patents are incorporated herein, to the extent consistent with our invention.

Although these prior art printing plates perform adequately, they are expensive to produce because the absorbing layer is vapor deposited onto the oleophilic polyester layer. Adhesive bonding of the polyester layer to a metal substrate also adds to the cost.

A principal objective of the present invention is to provide a printing plate suitable for imaging by laser radiation wherein the absorbing layer is a plurality of particles or a thermoplastic or elastomeric layer.

A related objective of the invention is to provide a printing plate suitable for imaging by laser radiation wherein a thermoplastic or elastomeric layer is joined to a metal substrate without an additional adhesive layer between the thermoplastic or elastomeric layer and the metal substrate.

Further objectives and advantages of our invention will become apparent to persons skilled in the art from the following detailed description.

SUMMARY OF THE INVENTION

In accordance with the present invention, there is provided a sheet material suitable for imaging by laser radiation. The sheet material is useful for both lithographic printing and flexographic printing.

In a first embodiment, the sheet material comprises a sheet substrate coated with a thermoplastic or elastomeric adhesive layer and a particle layer characterized by ablative absorption of laser radiation adhered to the adhesive layer. The particle layer is overcoated with a silicone or silicate layer that is not subject to ablative absorption of laser radiation.

The substrate may be a sheet of metal or polymer or a cellulosic material such as cardboard, paper, or polymer-impregnated paper. The cellulosic material may be derived from various sources such as wood, reclaimed paper, abaca, and jute. Combinations of such materials are also contemplated, including metal-polymer laminates, metal-cardboard laminates and metal-paper laminates. The substrate is preferably an aluminum alloy or steel. Some suitable polymer substrates include polyesters, polyolefins, acrylics, polyamides and polyvinyl chlorides. Some suitable aluminum alloys include alloys of the AA 1000, 3000 and 5000 series. Aluminum alloys of the AA 5000 series containing about 0.5–10 wt. % magnesium are particularly preferred.

The substrate should have a thickness of about 1–30 mils, preferably about 5–20 mils and more preferably about 8–20 mils. An unanodized AA 5182-H19 aluminum alloy substrate having a thickness of about 8.8 mils is utilized in a particularly preferred embodiment.

A principal surface of the substrate is cleaned to remove surface contaminants, such as lubricant residues. Some suitable surface cleaners include alkaline and acid aqueous solutions, plasma and laser radiation. After the principal surface is cleaned, it may be conversion coated to improve bonding to the adhesive layer. A chrome-phosphate conversion coating is particularly preferred. Other suitable conversion coatings may contain chromates, phosphates and silicates. Chrome-free conversion coatings may contain metals such as vanadium, niobium, tantalum, titanium, zirconium and hafnium.

The adhesive layer may contain an elastomeric polymer or a thermoplastic polymer. Some suitable thermoplastics include polyvinyl chloride and the polyolefins, polycarbonates, polyamides and polyesters such as polyethylene terephthalate (PET). Some suitable elastomeric polymers include polybutadiene, polyether urethanes and poly (butadiene-co-acrylonitrile).

A preferred PET resin is a high melt viscosity (HMV) resin of the type which has heretofore been used to coat openable metal trays and food packaging foils. SELAR® PT8307 HMV copolymer resin sold by E. I. Du Pont de Nemours Company is an example of a suitable PET resin. The copolymer may be used alone or in a blend with other thermoplastic polyesters. For example, a blend of SELAR® PT 8307 HMV copolymer with T89 PET sold by Hoechst-Celanese may provide satisfactory performance.

The adhesive layer may be coated onto the metal substrate by any of several coating means including spraying, roll coating, dipping, electrocoating, powder coating, laminating and extrusion coating. In one embodiment suitable for flexographic printing, PET is extrusion coated onto one side of an aluminum alloy substrate at a coating thickness of about 13.0 mils (330 microns). The PET may be extrusion coated onto both sides of the substrate and its thickness should be at least about 6 mils (150 microns) on each side. When the sheet material is used for flexographic printing, a coating of PET having a thickness of about 8–30 mils (200–760 microns) on only one side is preferred.

In another embodiment suitable for offset lithographic printing, a thermoplastic adhesive coating of about 0.25–2 mils (6–50 microns) is suitable. In a particularly preferred embodiment, PET is extrusion coated onto one side of an aluminum alloy substrate at a coating thickness of about 0.5 mil (13 microns). When the PET is extrusion coated onto both sides of a substrate, its thickness should be at least about 0.25 mil (6 microns) on each side.

The polymer layer is preferably loaded with particles of a white pigment to improve its opacity. Some preferred pigments include titanium dioxide, alumina, calcium carbonate, silicon dioxide, talc and mixtures thereof The pigment should have an average particle size of about 10 microns or less, preferably less than about 2 microns. The pigment loading should be about 1–20 wt. %, preferably about 2–10 wt. %. A preferred PET polymer layer contains titanium dioxide particles having an average particle size of about 0.2–-0.3 microns.

The pigmented adhesive layer is preferably extrusion coated onto one side of an aluminum alloy sheet by heating the sheet, extruding pigmented PET onto one side while it is at a temperature of at least about 400° F. (204° C.), heating the coated sheet to at least the glass transition temperature of the PET, and then cooling the coated sheet. The extrusion die is positioned about 10–200 mm away from the sheet. The sheet travels about 10–20 times faster than extrudate flowing from the extrusion die, so that the extrudate is reduced in thickness by pull of the metal sheet. The molten polymer impinges upon the metal sheet surface almost immediately after exiting the die, so that the polymer has no opportunity to cool before it is applied. A uniform coating is thereby ensured over the sheet surface.

Additional details of the particularly preferred extrusion coating process are revealed in Smith et al U.S. Pat. No. 5,407,702. The disclosure of the Smith et al patent is incorporated herein, to the extent consistent with the present invention.

The adhesive layer is reheated to a temperature near its melting temperature in order to facilitate contact with particles. When the polymer layer is PET having a melting point of about 450° F. (232° C.), the coated sheet is preferably heated to about 435–465° F. and more preferably about 440–460° F. The adhesive layer is preferably heated to within about 15° F. (8° C.) of its melting point before the particle coating is applied, more preferably within about 10° F. (6° C.). At these temperatures, the adhesive layer is in a molten or semi-molten condition.

The particles applied to the adhesive layer may be carbon or metal or mineral particles. Carbon may be used in the form of carbon black, lamp black or other commercially available particles. The metal particles may be copper, cobalt, nickel, lead, cadmium, titanium, iron, bismuth, tungsten, tantalum, silicon, chromium, aluminum or zinc. The mineral particles may be the oxides, borides, carbides, sulfides, halides or nitrides of the metals identified above. The particles may be applied to the adhesive layer as a single layer or in a plurality of discrete layers. Combinations of particles having different composition are within the scope of our invention. The particles may be surface modified by treatment with an adhesion promoter to improve bond strength between the particles and the adhesive layer. The particles form a particle layer having a thickness about 1–10% of the adhesive layer thickness.

The particles have an average particle size of less than about 20 microns, preferably about 0.01–10 microns and more preferably about 0.1–2 microns. The particles preferably have an aspect ratio of at least 2. An aspect ratio of about 2–50 is preferred.

The particles may be alumina particles including aluminum trihydroxides, namely, gibbsite and bayerite; alumina oxyhydroxide, namely, boehmite and norstrandite; all of the transition forms of alumina; and calcined alumina, namely, alpha alumina. Boehmite particles having an average size of about 1.2 microns are utilized in one preferred embodiment. If desired, the alumina particles may be treated with a sealant which may be an organo-phosphorus compound such as an organophosphonic acid, an organophosphonate, an organophosphoric acid or an organophosphate.

The particle layer is overcoated with a silicone or silicate layer that is not subject to ablative absorption of laser radiation. The silicone or silicate layer may include either a silicone or a metal silicate such as sodium silicate. Silicones are particularly preferred. The layer has a thickness of about 0.5–20 microns, preferably about 0.5–5 microns and optimally about 1 micron.

DETAILED DESCRIPTION OF THE PREFERRED EMBODIMENTS

Figure 1:
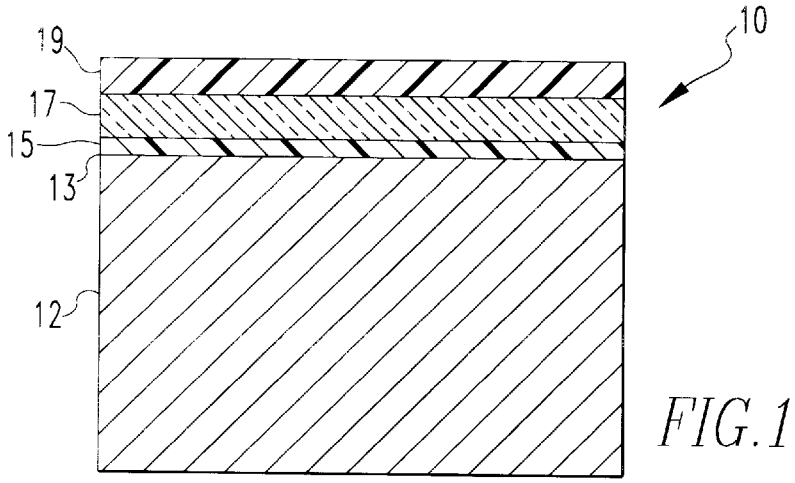
FIGS. 1–4 are schematic, fragmentary cross-sectional views of various sheet materials made in accordance with the present invention.

Referring now to FIG. 1, there is shown a preferred printing plate 10 made in accordance with the present invention. The plate 10 includes an aluminum alloy substrate 12 having a principal surface 13, a PET adhesive layer 15 coated onto the principal surface 13, a layer of alumina particles 17 adhering to the adhesive layer 15 and a silicone top layer 19 overlying the particle layer 17. The substrate 12 is an AA 5182-H19 aluminum alloy sheet having a thickness of about 8.8 mils (224 microns). The adhesive layer 15 has a thickness of about 0.5 mil (13 microns) and contains PET filled with about 1 wt. % titanium dioxide particles. The particle layer contains boehmite particles having an average particle size of about 1.2 microns. The silicone top layer 19 has a thickness of about 1 micron (0.04 mil).

A laser beam delivers a microsecond pulse to the plate 10. The beam passes through the silicone layer 19 and is absorbed by the particle layer 17, converting the light energy to heat. When the silicone layer is heated, it decomposes near the particles 17 and creates a recess (not shown).

Ink is applied to the plate 10 by ink rolls. The ink fills recesses created by the laser light. Initially, ink also reaches top surfaces of the silicone layer 19, but the ink does not remain there because the cohesive force of ink to ink on the roll is greater than the adhesive force of the ink to the silicone layer. Ink is lifted off the silicone layer and returned to the ink roll.

Ink in the recessed areas is transferred to a rubber blanket roll. The blanket roll transfers the ink to paper or other print media. For color printing, different colors of ink are applied sequentially to the print media in this "wet on wet printing". As the print media are stacked, an offset powder is applied to the wet print surface. This powder separates the stacked print copies so that the solvent can evaporate and the ink can dry.

The laser imaging process described herein is conducted on the plate drum of a printing press. This improves the accuracy of plate registry for four-color printing.

Figure 2:
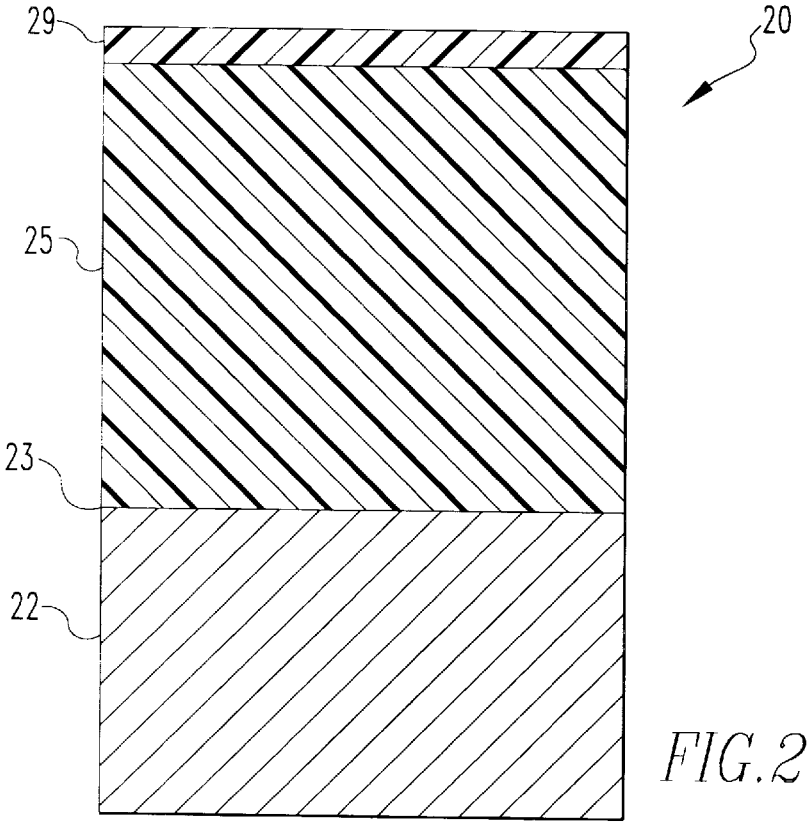
Figure 3:
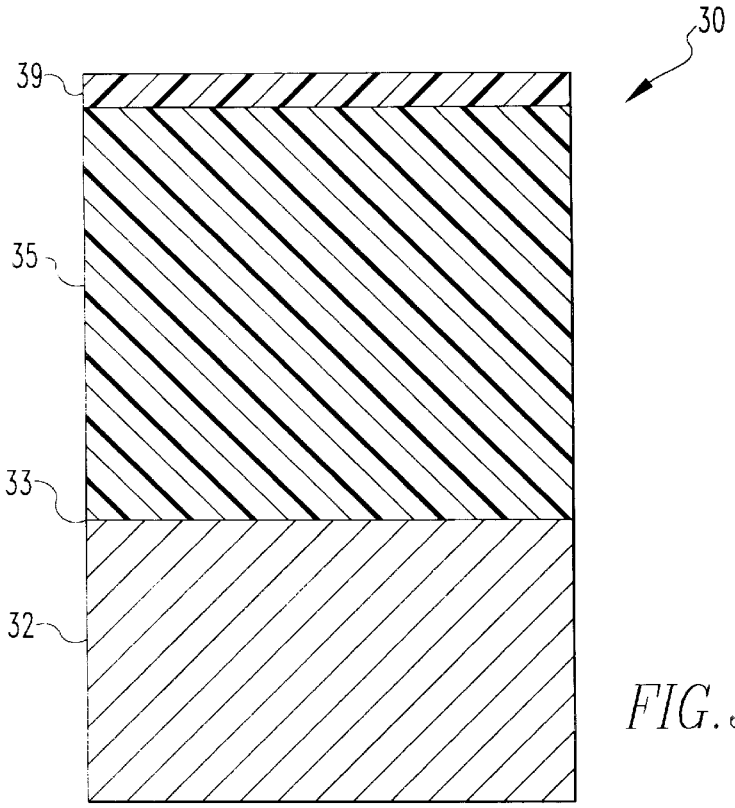
Figure 4:
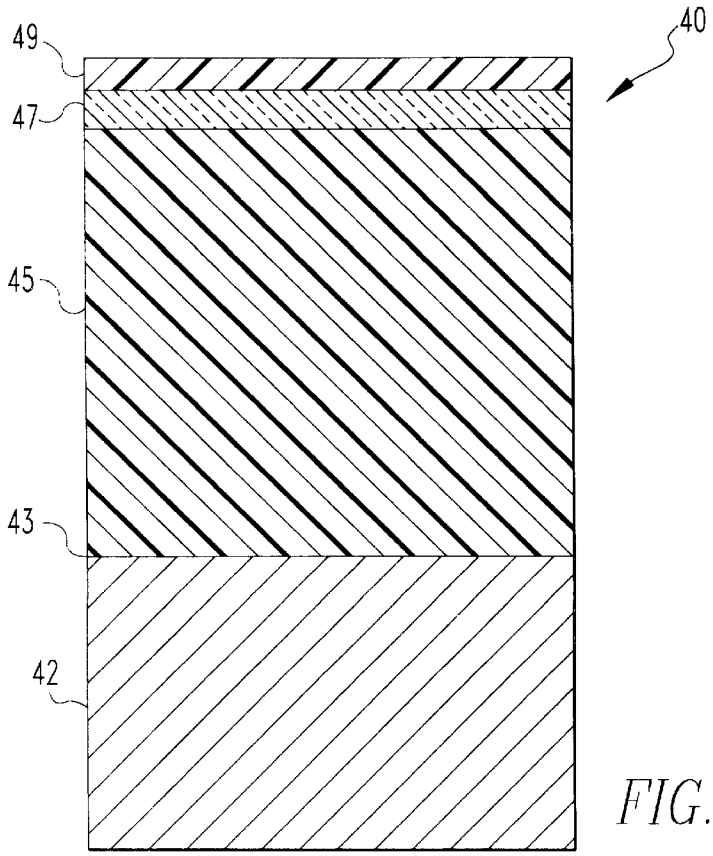

Some alternative embodiments of our invention are shown in FIGS. 2, 3 and 4. These embodiments are sheet materials for flexographic printing processes.

The sheet material 20 shown in FIG. 2 includes a substrate 22 having a principal surface or top surface 23, an adhesive layer 25 coated onto the top surface 23, and a silicone or silicate layer 29 overlying the adhesive layer 25. In the preferred embodiment shown, the substrate 22 is an unanodized AA5182-H19 aluminum alloy sheet having a thickness of about 8.8 mils. The adhesive layer 25 is PET and has a thickness of about 13 mils (330 microns). The adhesive layer 25 is subject to ablative absorption of laser radiation even though it contains no filler particles. The top layer 29 contains a silicone and has a thickness of approximately 1 micron.

The sheet material 30 shown in FIG. 3 includes a substrate 32 having a principal surface 33, an adhesive layer 35 containing filler particles coated onto the principal surface 33, and a silicone or silicate layer 39 overlying the adhesive layer 35. In the preferred embodiment shown, the substrate 32 is an unanodized AA5182-H19 aluminum alloy sheet having a thickness of about 8.8 mils. The adhesive layer 35 is PET filled with titanium dioxide particles and has a thickness of about 13 mils. The titanium dioxide particles are more sensitive to laser radiation than the PET in the adhesive layer 35. The top layer 39 contains a silicone and has a thickness of about 1 micron.

The sheet material 40 shown in FIG. 4 includes a substrate 42 having a principal surface or top surface 43, an adhesive layer 45 coated onto the top surface 43, a particle layer 47 adhered to the adhesive layer 45, and a silicone or silicate layer 49 overlying the particle layer 47. In the preferred embodiment of FIG. 4, the substrate 42 is an unanodized AA5182-H19 aluminum alloy sheet having a thickness of about 8.8 mils. The adhesive layer 45 has a thickness of about 13 mils and is PET containing no filler particles. The particle layer 47 contains boehmite particles having an average particle size of about 1.2 microns. The top layer 49 is a silicone layer having a thickness of approximately 1 mil (25 microns).

Having described the presently preferred embodiments, it is to be understood that the invention may be otherwise embodied within the scope of the appended claims.

What is claimed is:

1. A process for making sheet material suitable for imaging by laser radiation, said process comprising:

(a) providing a substrate comprising a sheet of a material selected from the group consisting of metals, polymers, cellulosic material, and combinations thereof;

(b) coating said substrate with an adhesive layer comprising a thermoplastic or elastomeric polymer;

(c) overcoating said adhesive layer with a layer not subject to ablative absorption of laser radiation and comprising a silicone or silicate;

(d) after step (b) and before step (c), maintaining said adhesive layer at one or more temperatures near its melting point; and (e) while maintaining said adhesive layer at said one or more temperatures, adhering to said adhesive layer a particle layer characterized by absorption of laser radiation and consisting essentially of a plurality of carbon or metal or mineral particles.

2. The process of claim 1 wherein said adhesive layer contains a plurality of carbon or metal or mineral particles characterized by greater absorption of laser radiation than said thermoplastic or elastomeric polymer.

3. The process of claim 1 wherein said substrate comprises an aluminum alloy or steel.

4. The process of claim 1 wherein said substrate comprises an unanodized aluminum alloy sheet and said process further comprises:

(e) conversion coating an outer surface portion of said sheet before coating said outer surface portion with said adhesive layer.

5. The process of claim 1 wherein said substrate has a thickness of about 5–30 mils (127–762 microns) and said adhesive layer has a thickness of about 0.25–30 mils (6–760 microns).

6. The process of claim 1 wherein said adhesive layer comprises a polymer selected from the group consisting of polyesters, polyolefins, polyamides, polycarbonates, polyvinyl chlorides, and mixtures thereof.

7. The process of claim 1 wherein step (b) comprises extrusion coating onto said substrate an adhesive layer comprising polyethylene terephthalate.

8. The process of claim 1 wherein step (c) comprises maintaining said adhesive layer at one or more temperatures within about 15° F. above or below its melting point.

9. The process of claim 1 wherein said particles have an average particle size of less than about 10 microns.

10. The process of claim 1 wherein said particles comprise carbon or a metal selected from the group consisting of copper, cobalt, nickel, lead, cadmium, titanium, iron, bismuth, tungsten, tantalum, silicon, chromium, aluminum and zinc or an oxide, boride, carbide, sulfide, halide or nitride of said metal.

11. The process of claim 1 wherein said particles comprise titanium particles having an average particle size of less than about 2 microns.

12. The process of claim 1 wherein said particles have an aspect ratio of at least 2.

13. A process for making sheet material suitable for imaging by laser radiation, said process comprising:

(a) providing a substrate comprising a sheet of a material selected from the group consisting of metals, polymers, cellulosic materials and combinations thereof;

(b) coating said substrate with an adhesive layer comprising a thermoplastic or elastomeric polymer;

(c) maintaining said adhesive layer at one or more temperatures near its melting point; and (d) while maintaining said adhesive layer at said one or more temperatures, adhering to said adhesive layer a particle layer consisting essentialy of a plurality of carbon or metal or mineral particles or mixtures thereof, said particle layer being characterized by ablative absorption of laser radiation.

14. The process of claim 13 further comprising:

(e) overcoating said particle layer with a silicone or silicate layer not subject to ablative absorption of laser radiation.

15. The process of claim 13 wherein said silicone or silicate layer comprises a silicone.

16. The process of claim 13 wherein said particles have an aspect ratio of at least 2.

17. The process of claim 13 wherein said substrate comprises an aluminum alloy.

18. The process of claim 17 wherein said aluminum alloy is unanodized.

19. The process of claim 13 wherein said particles comprise alumina.

* * * * *